US008148904B2

(12) United States Patent
Yang et al.

(10) Patent No.: US 8,148,904 B2
(45) Date of Patent: Apr. 3, 2012

(54) FIELD EMISSION APPARATUS AND DRIVING METHOD THEREOF

(75) Inventors: Dong Wook Yang, Seoul (KR); Yang Woon Na, Seoul (KR)

(73) Assignee: Hanwha Chemical Corporation, Seoul (KR)

( * ) Notice: Subject to any disclaimer, the term of this patent is extended or adjusted under 35 U.S.C. 154(b) by 524 days.

(21) Appl. No.: 12/310,811

(22) PCT Filed: Sep. 6, 2006

(86) PCT No.: PCT/KR2006/003538

§ 371 (c)(1),
(2), (4) Date: Mar. 5, 2009

(87) PCT Pub. No.: WO2008/029963

PCT Pub. Date: Mar. 13, 2008

(65) Prior Publication Data

US 2009/0273298 A1 Nov. 5, 2009

(51) Int. Cl.
*G09G 3/10* (2006.01)

(52) U.S. Cl. ..... 315/169.3; 313/495; 313/496

(58) Field of Classification Search ..... 315/169.1, 315/169.2, 169.3, 169.4; 313/309, 311, 495, 313/496

See application file for complete search history.

(56) References Cited

U.S. PATENT DOCUMENTS

| | | | | |
|---|---|---|---|---|
| 3,970,887 | A | 7/1976 | Smith et al. | |
| 5,473,219 | A * | 12/1995 | Ikeda | 313/497 |
| 5,656,887 | A * | 8/1997 | Voshell et al. | 313/496 |
| 5,773,834 | A | 6/1998 | Yamamoto et al. | |
| 5,821,685 | A * | 10/1998 | Peterson | 313/467 |
| 6,011,356 | A * | 1/2000 | Janning et al. | 315/169.4 |
| 6,147,456 | A * | 11/2000 | Janning | 315/169.3 |
| 6,404,136 | B1 * | 6/2002 | Murray et al. | 315/169.1 |
| 7,960,904 | B2 * | 6/2011 | Takai et al. | 313/311 |

FOREIGN PATENT DOCUMENTS

| | | | |
|---|---|---|---|
| JP | 2005-190835 | | 7/2005 |
| JP | 2006-156377 | | 6/2006 |
| KR | 1020000074609 | A | 12/2000 |
| KR | 1020010084384 | A | 9/2001 |
| KR | 1020040044101 | A | 5/2004 |
| KR | 1020060022094 | A | 3/2006 |

* cited by examiner

*Primary Examiner* — Tung X Le
(74) *Attorney, Agent, or Firm* — Abelman, Frayne & Schwab

(57) ABSTRACT

The present invention relates to a field emission apparatus and a method of driving the field emission apparatus, which has a three-pole structure of dual emitters formed on both first and second electrodes of a rear substrate in order to obviate a distinction between a gate and a cathode, thus enabling dual field emission. In such a field emission apparatus, a ground is formed between an anode and a point of the first and second electrodes of the rear substrate, and a square wave is applied thereto in order to alternately generate field emission in the first and second electrodes, thus increasing a light-emitting area and emission efficiency, decreasing a driving voltage and consumption power, saving the manufacturing cost and manufacturing time, and accomplishing a longer lifespan.

18 Claims, 14 Drawing Sheets

[Fig. 1]
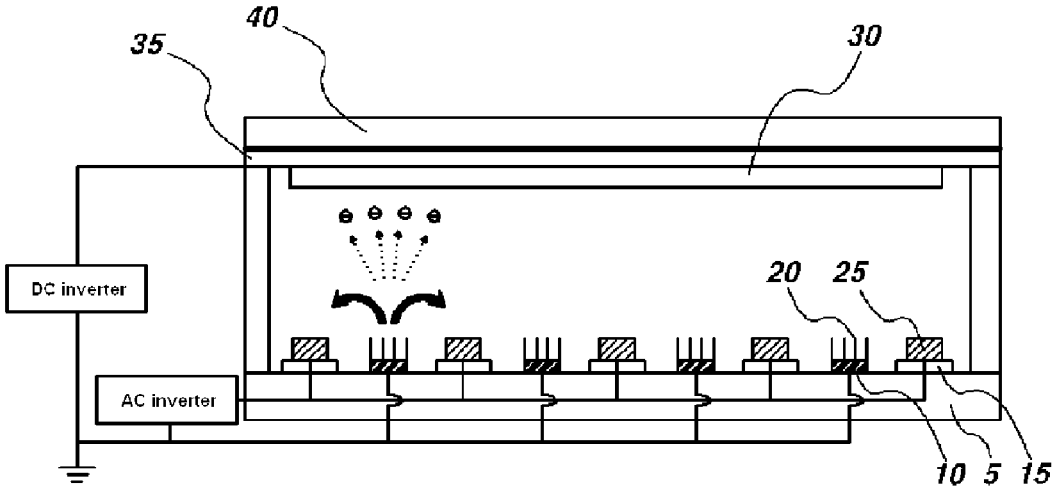
[Fig. 2]
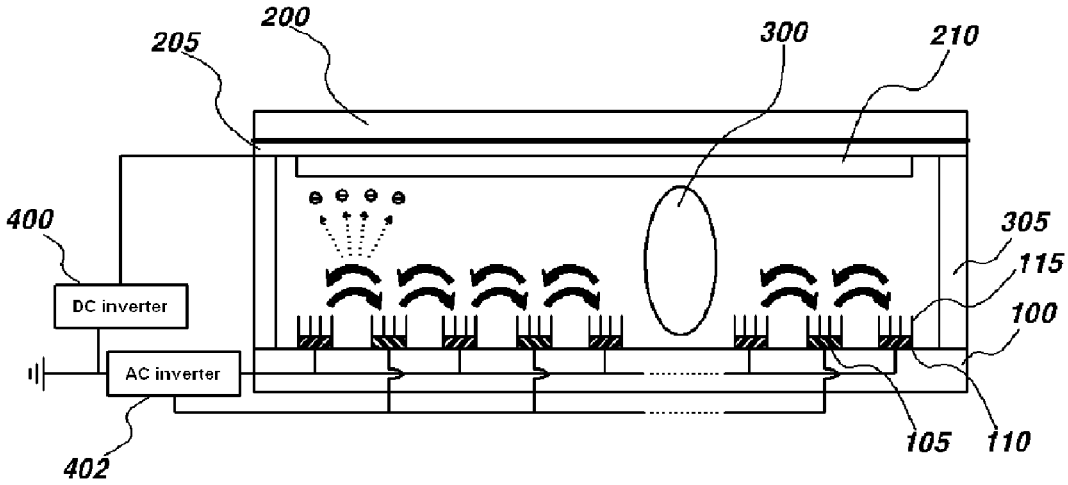

[Fig. 3]
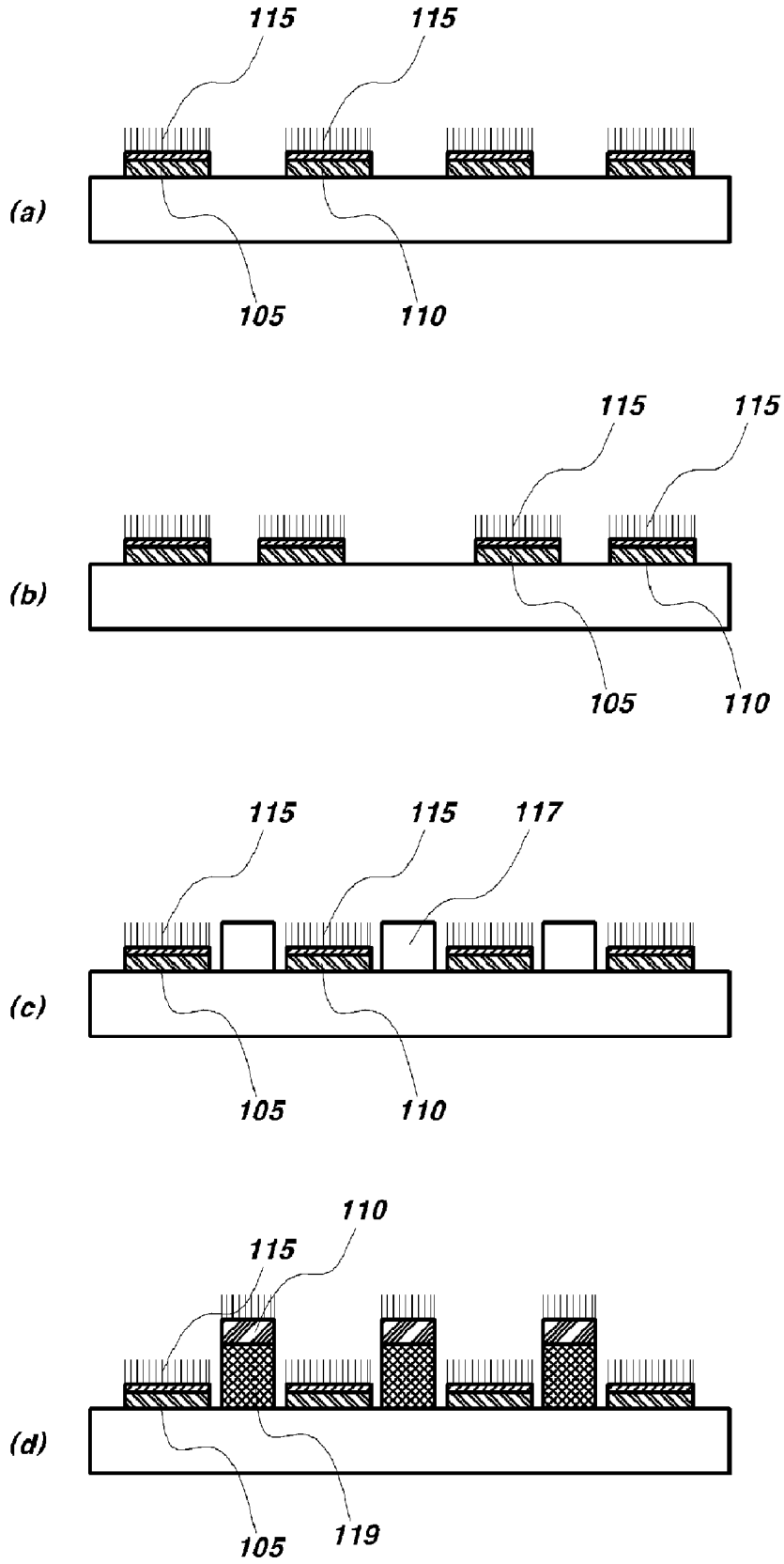

[Fig. 4]
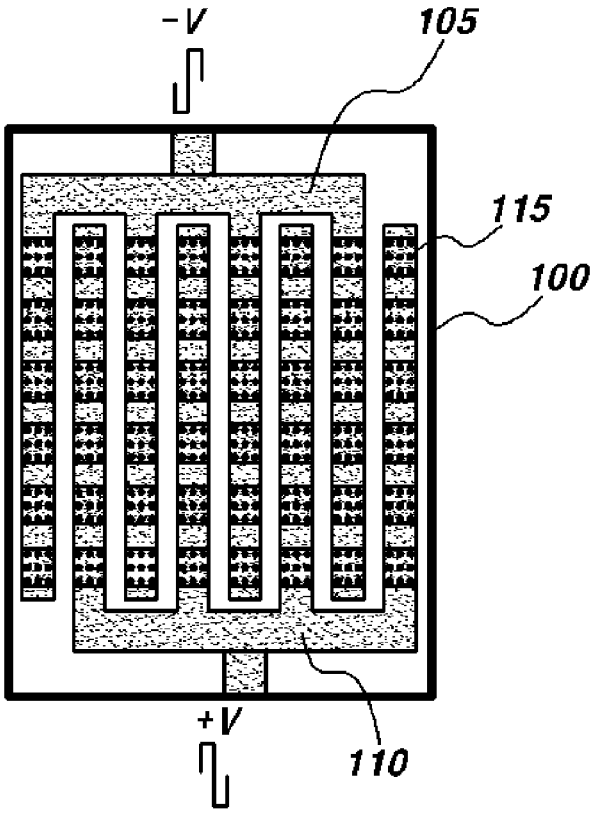
[Fig. 5]
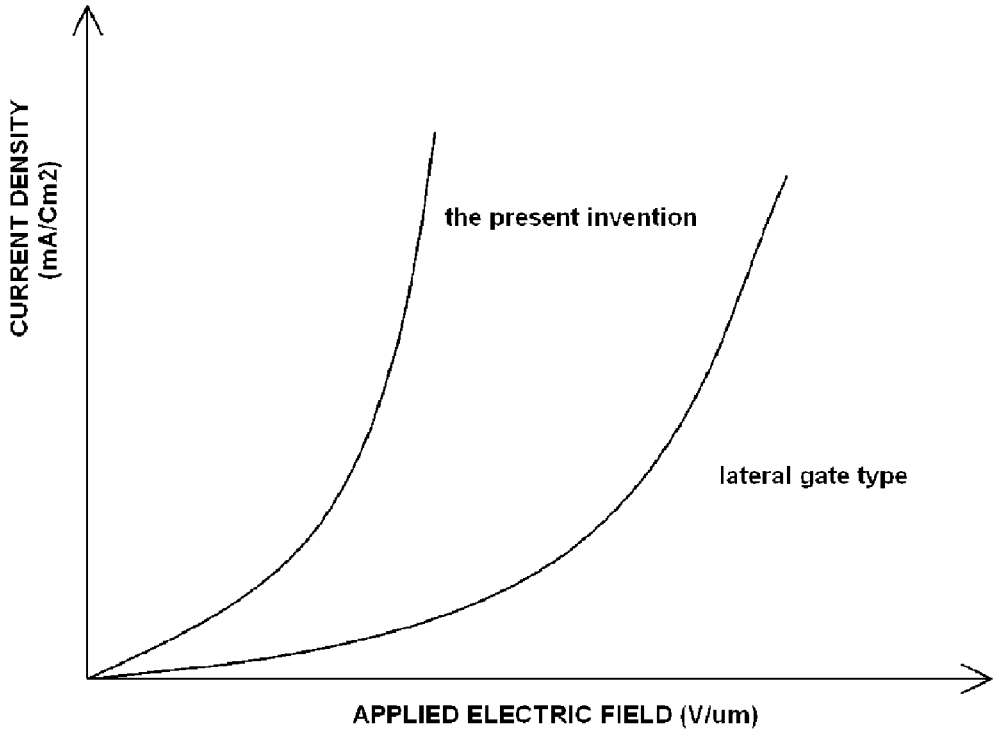

[Fig. 6]
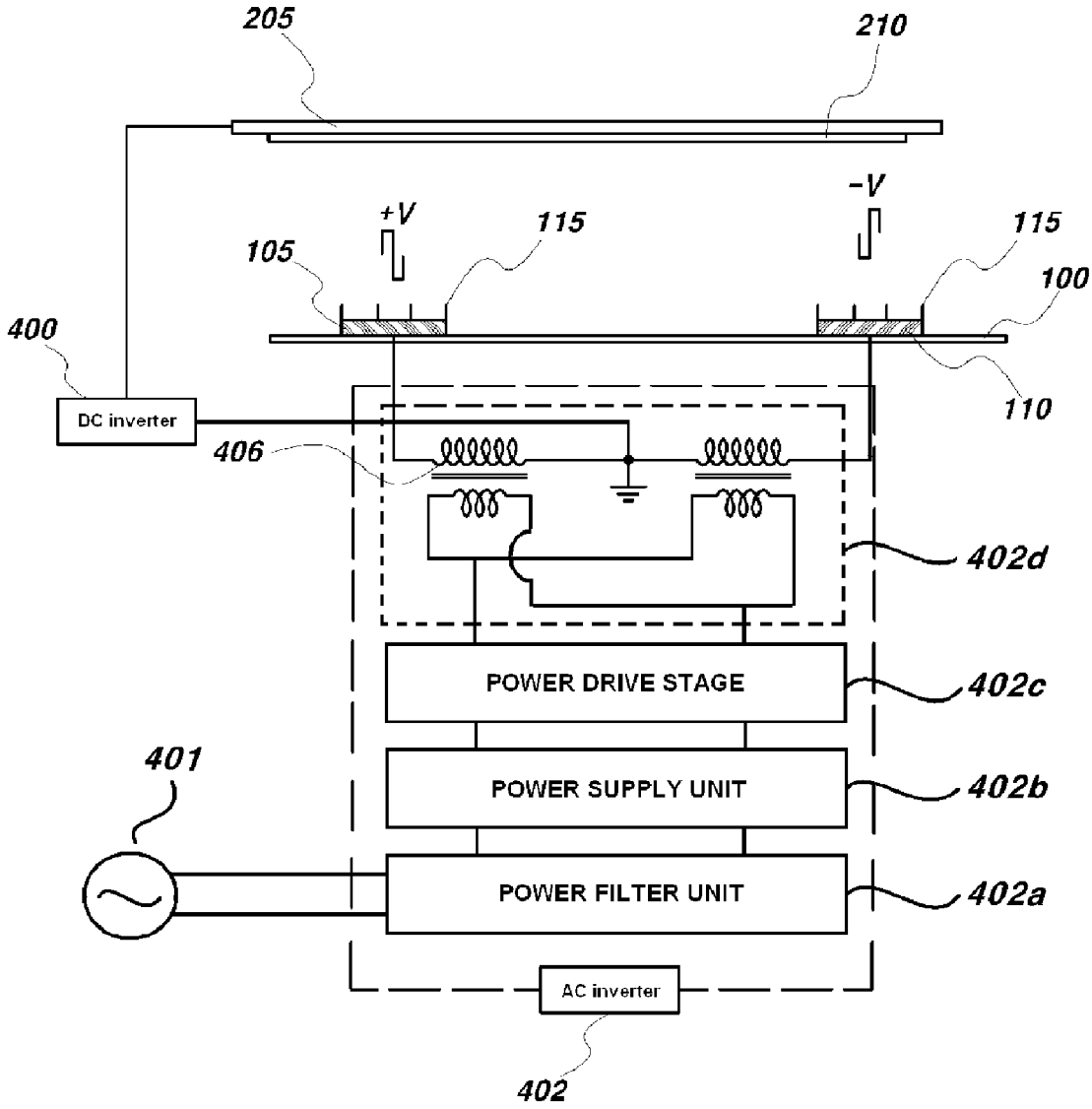

[Fig. 7]
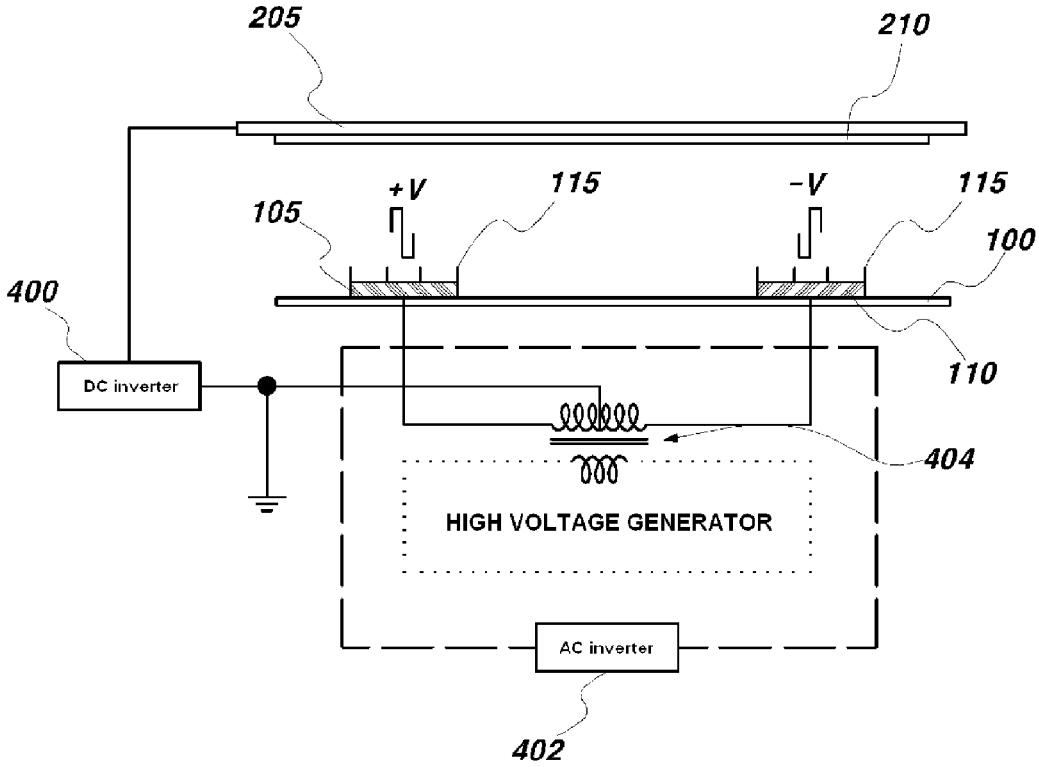
[Fig. 8]
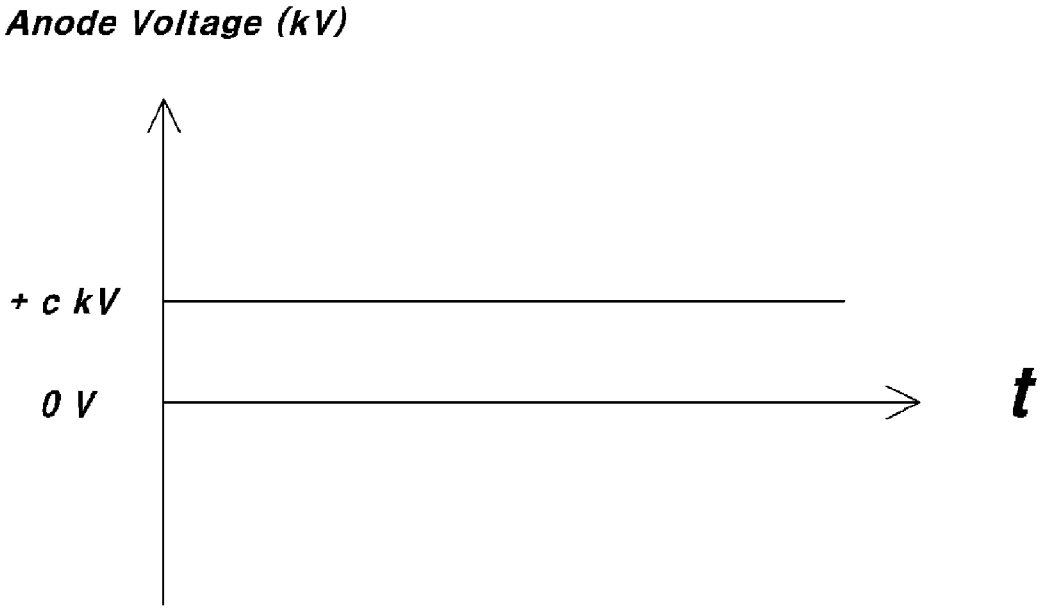

[Fig. 9]
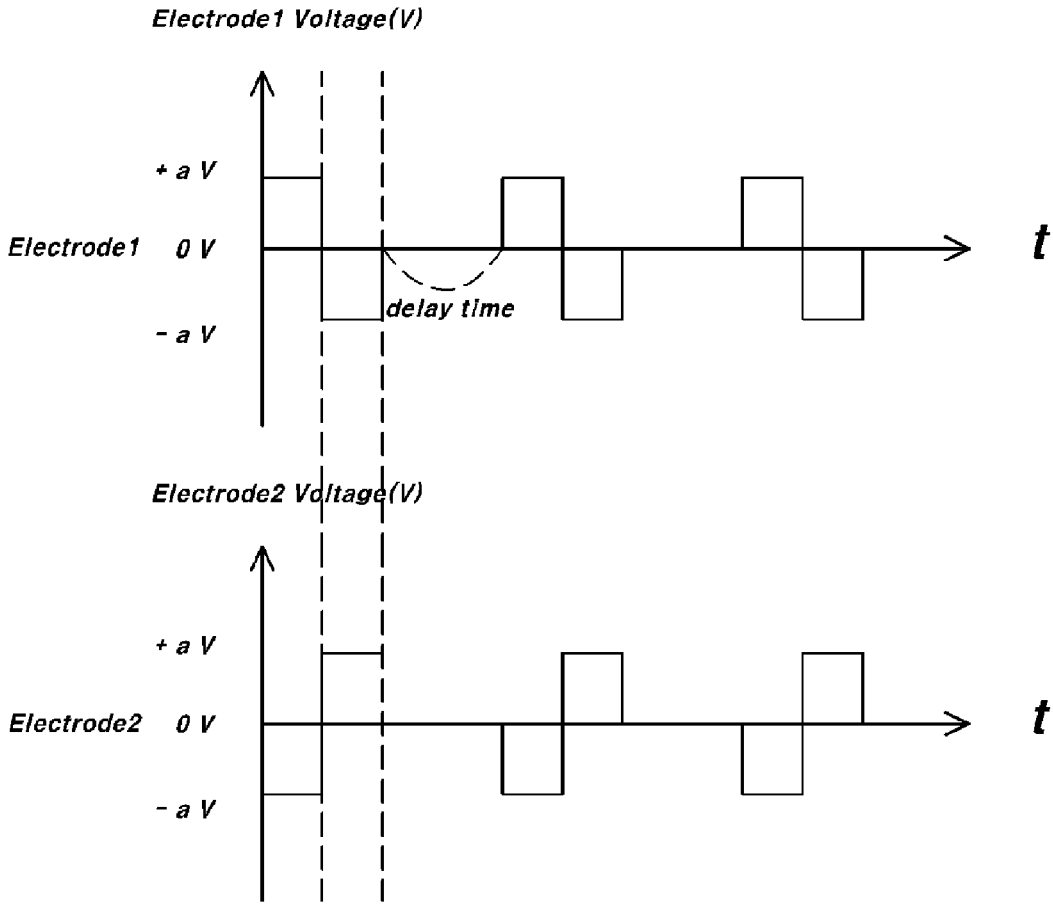
[Fig. 10]
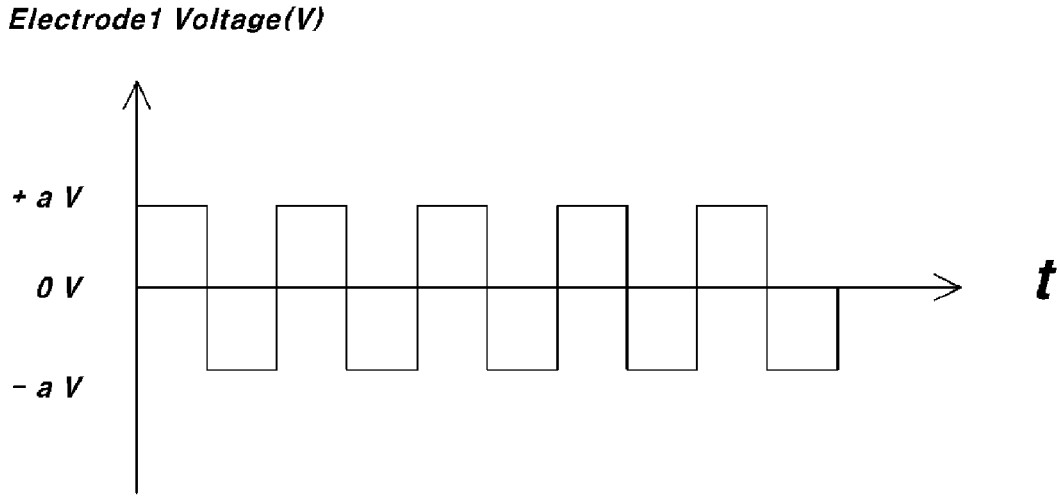

[Fig. 11]
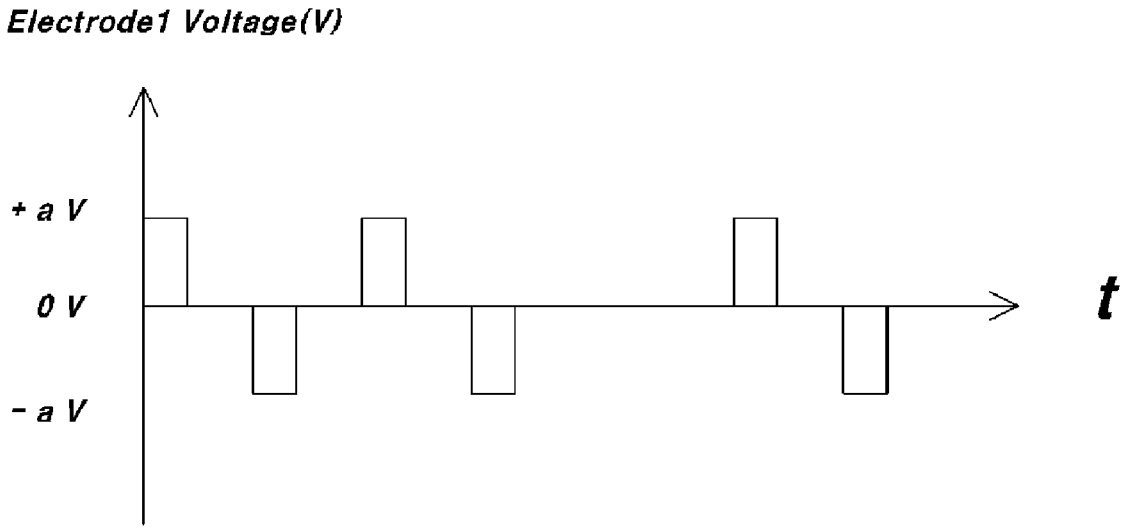
[Fig. 12]
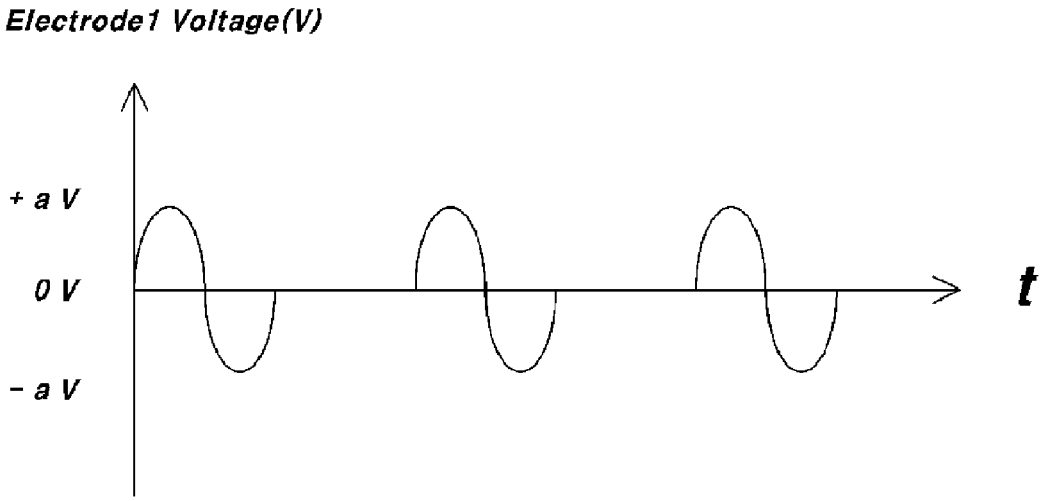

[Fig. 13]
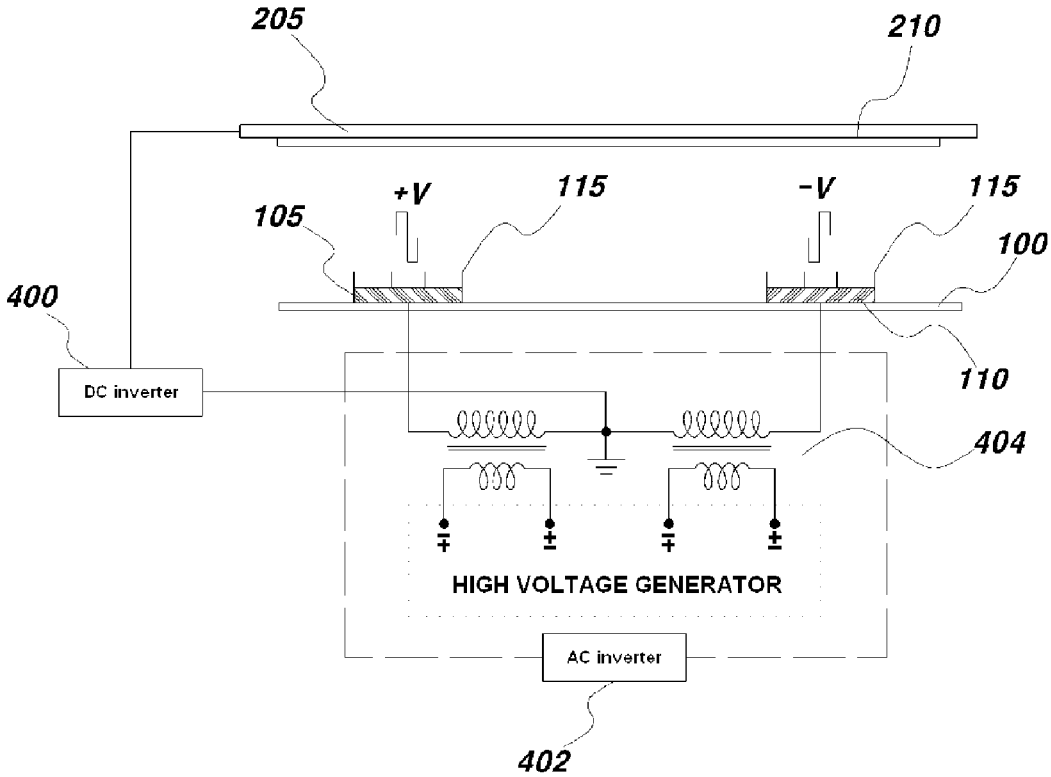
[Fig. 14]
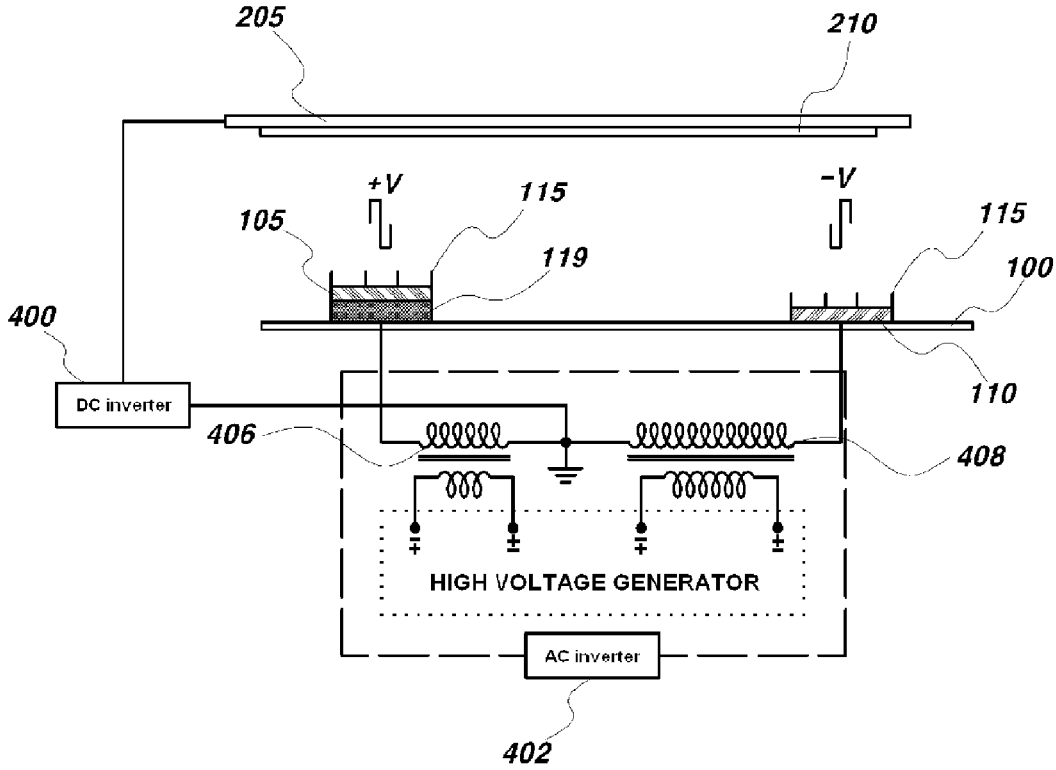

[Fig. 15]
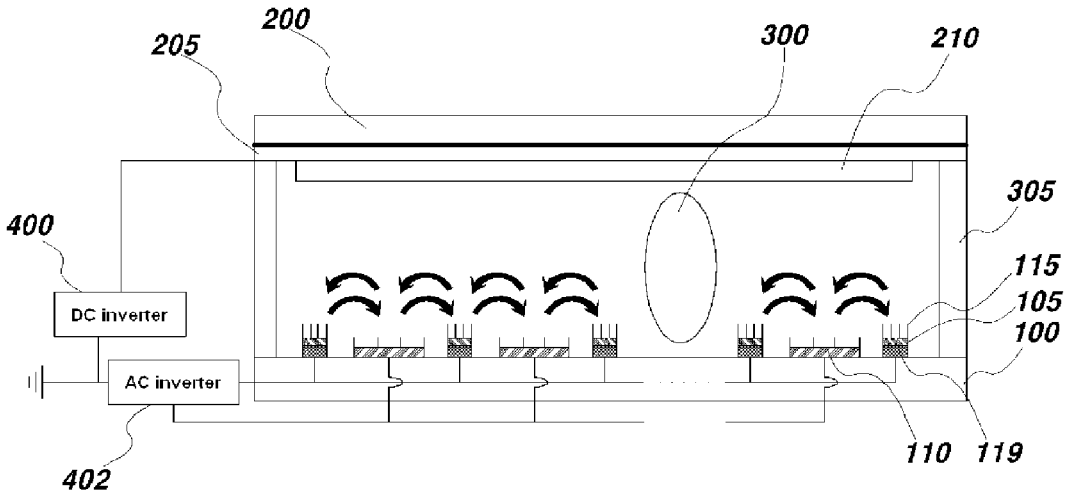
[Fig. 16]
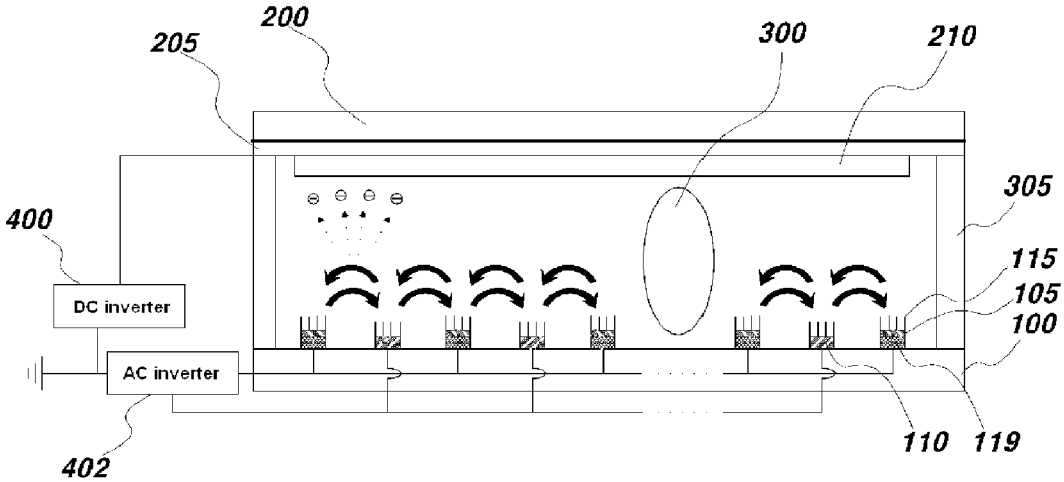
[Fig. 17]
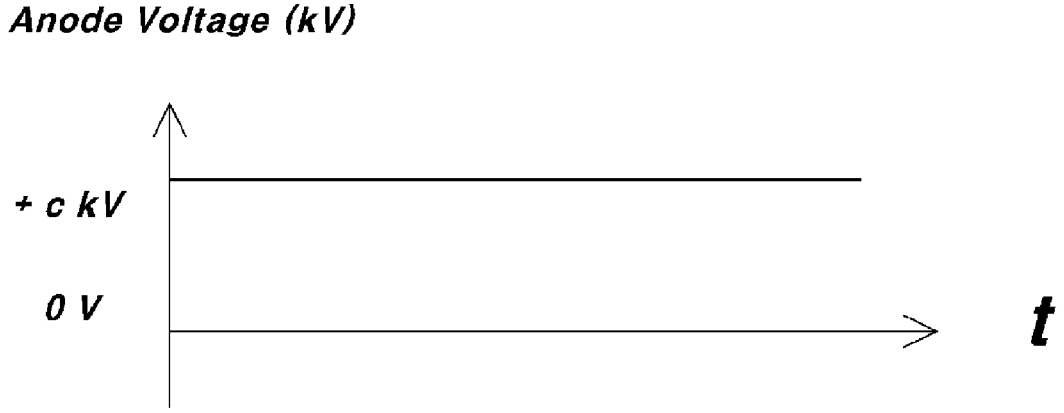

[Fig. 18]
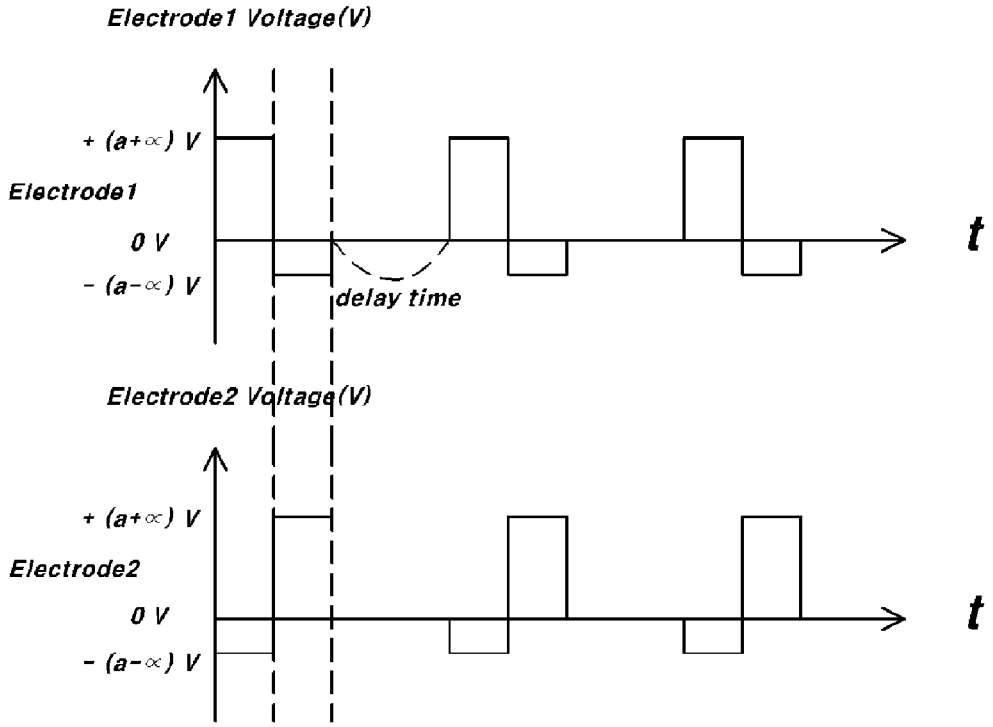
[Fig. 19]
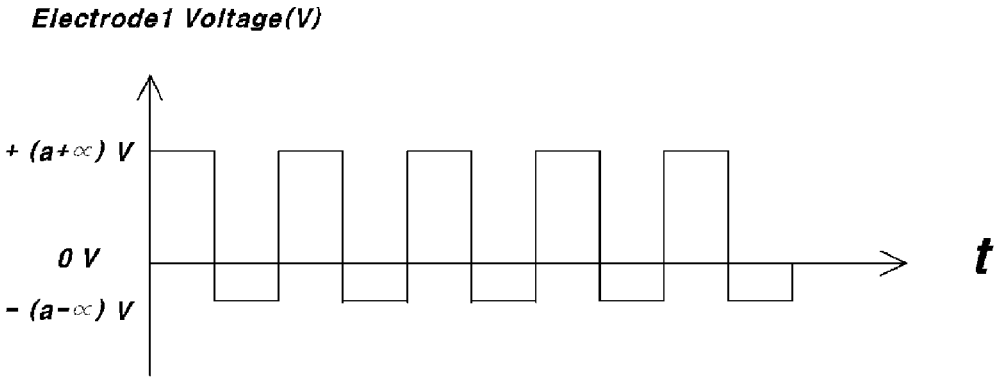
[Fig. 20]
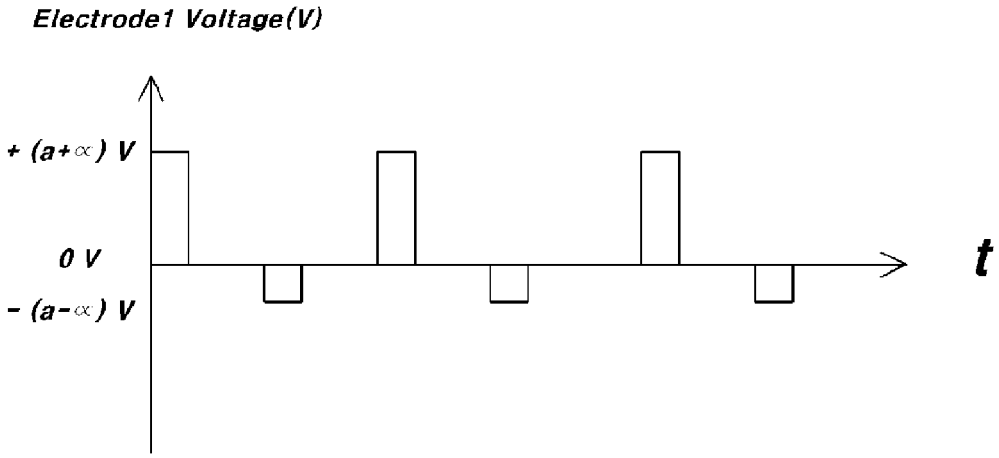

[Fig. 21]
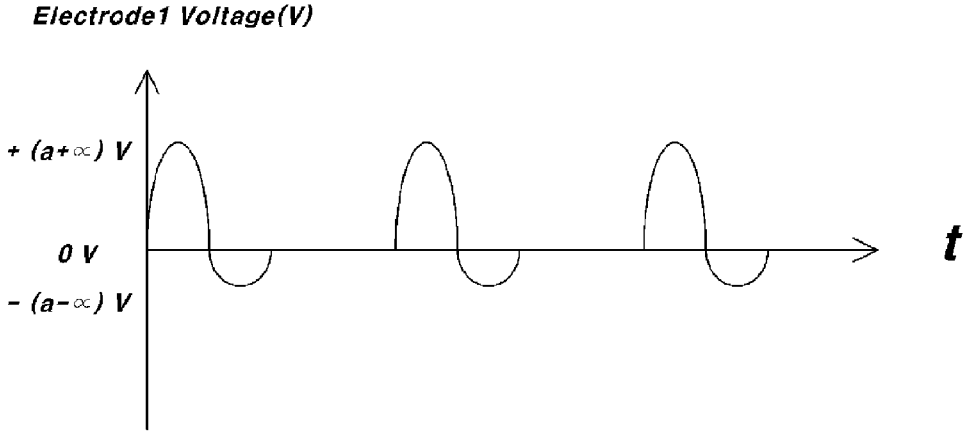
[Fig. 22]
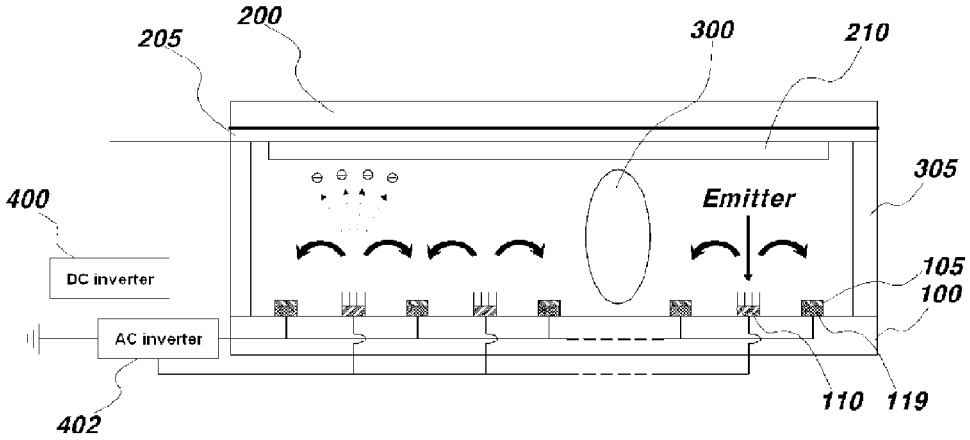
[Fig. 23]
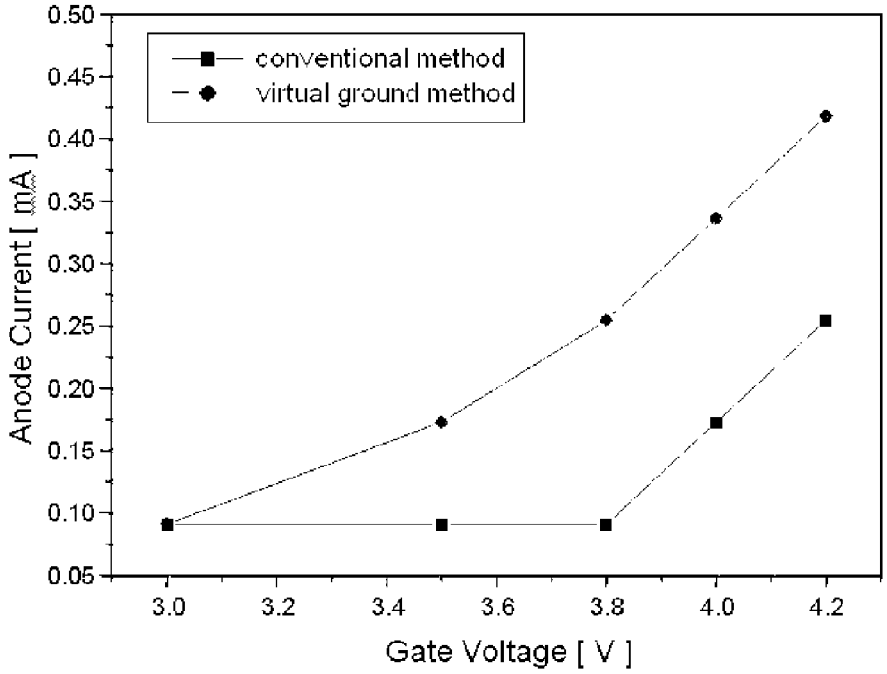

[Fig. 24]
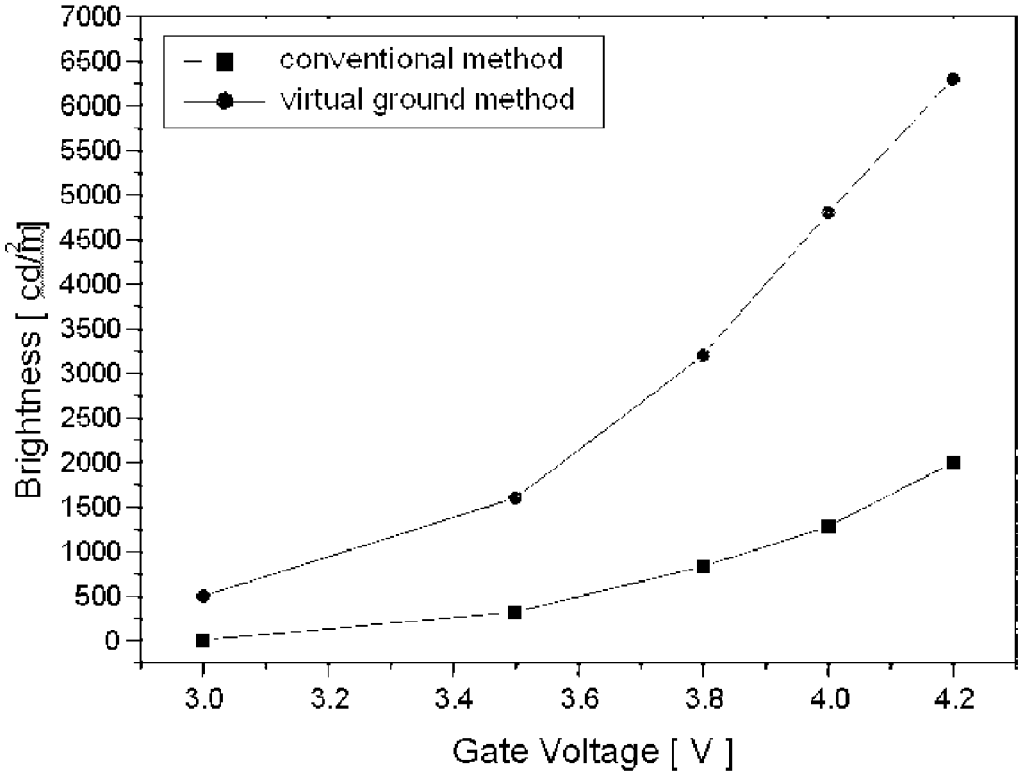
[Fig. 25]
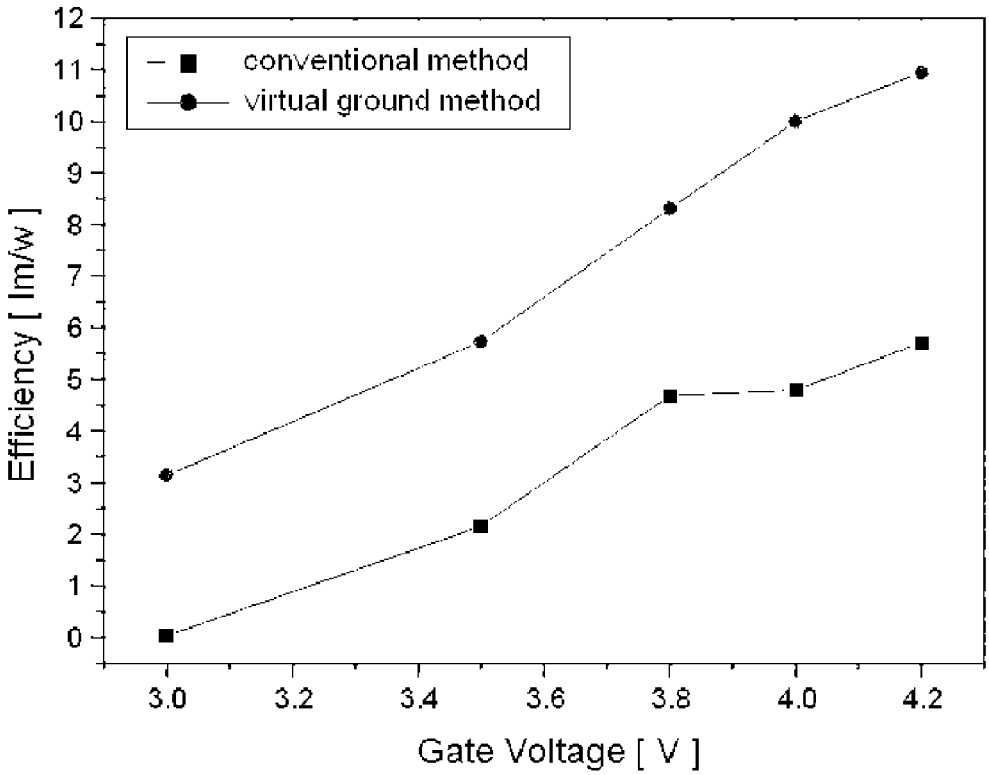

[Fig. 26]
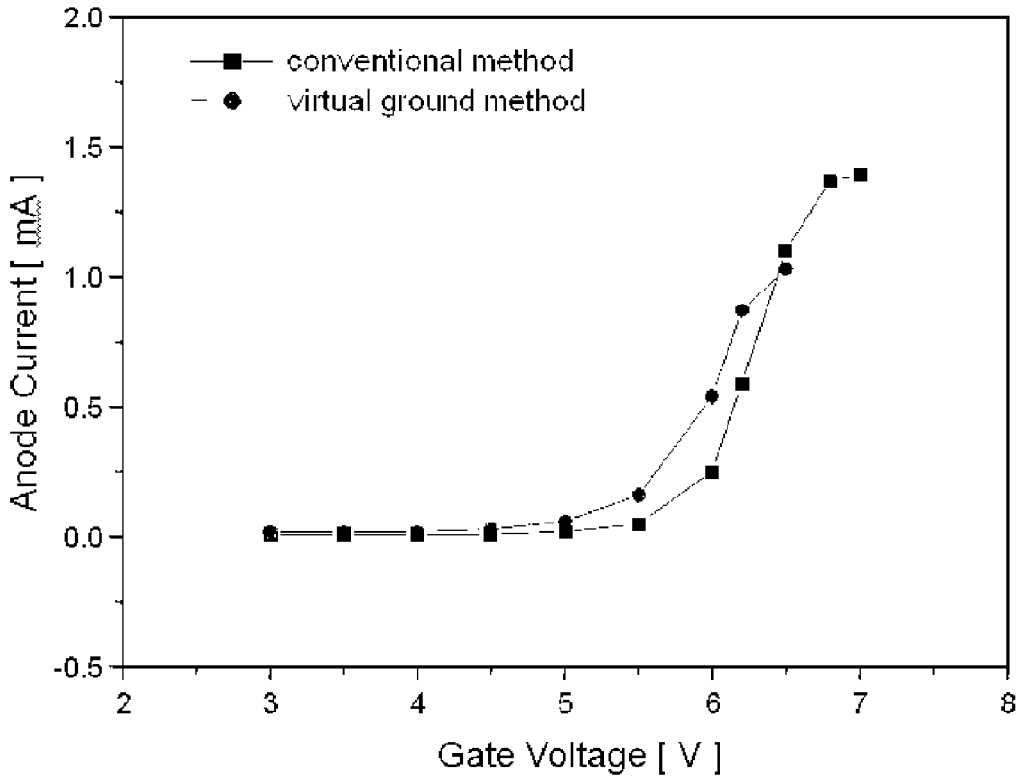
[Fig. 27]
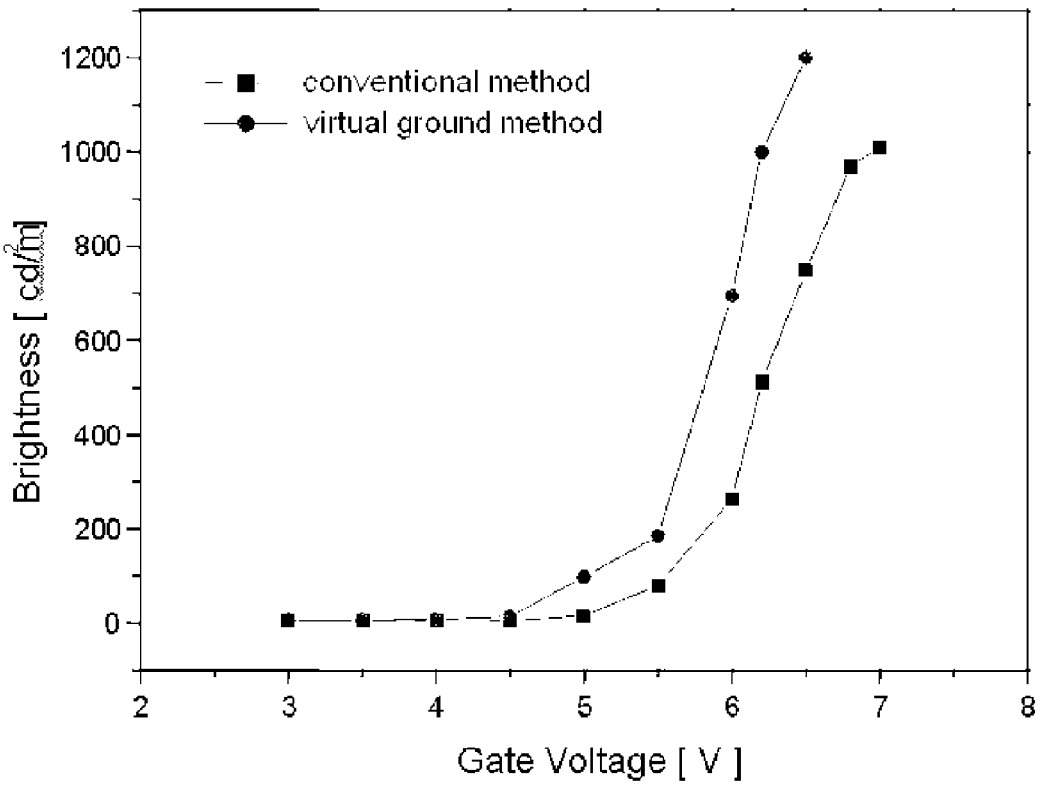

[Fig. 28]
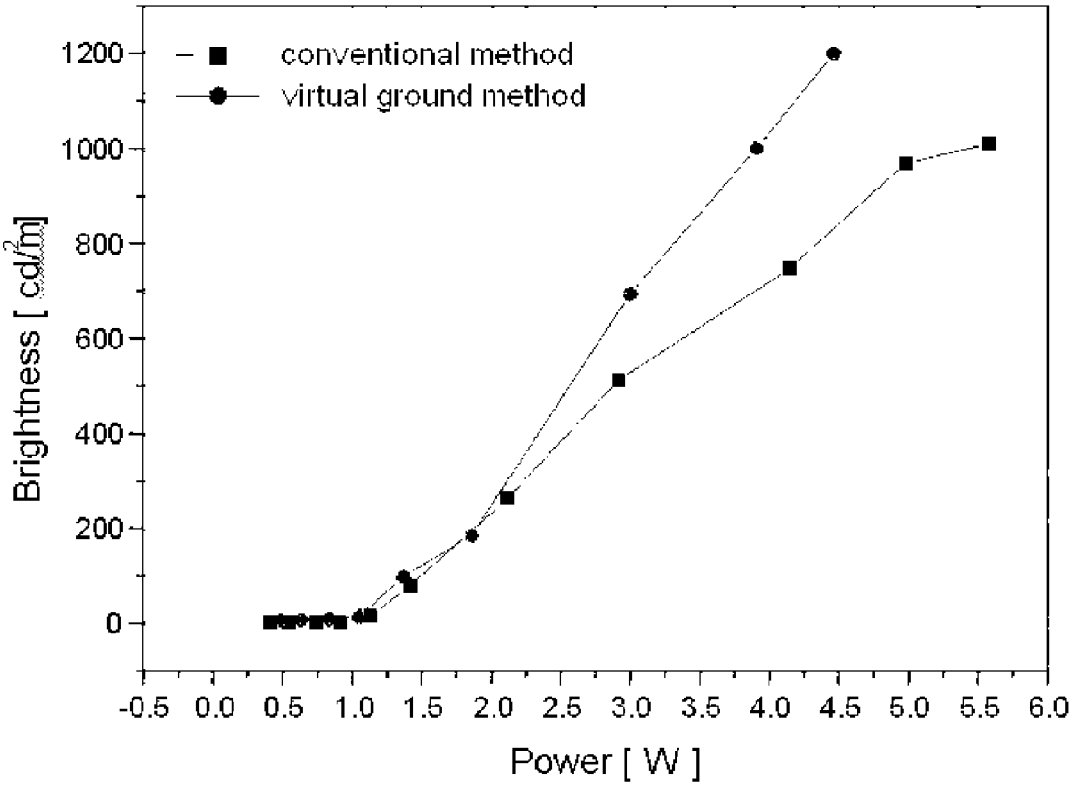
[Fig. 29]
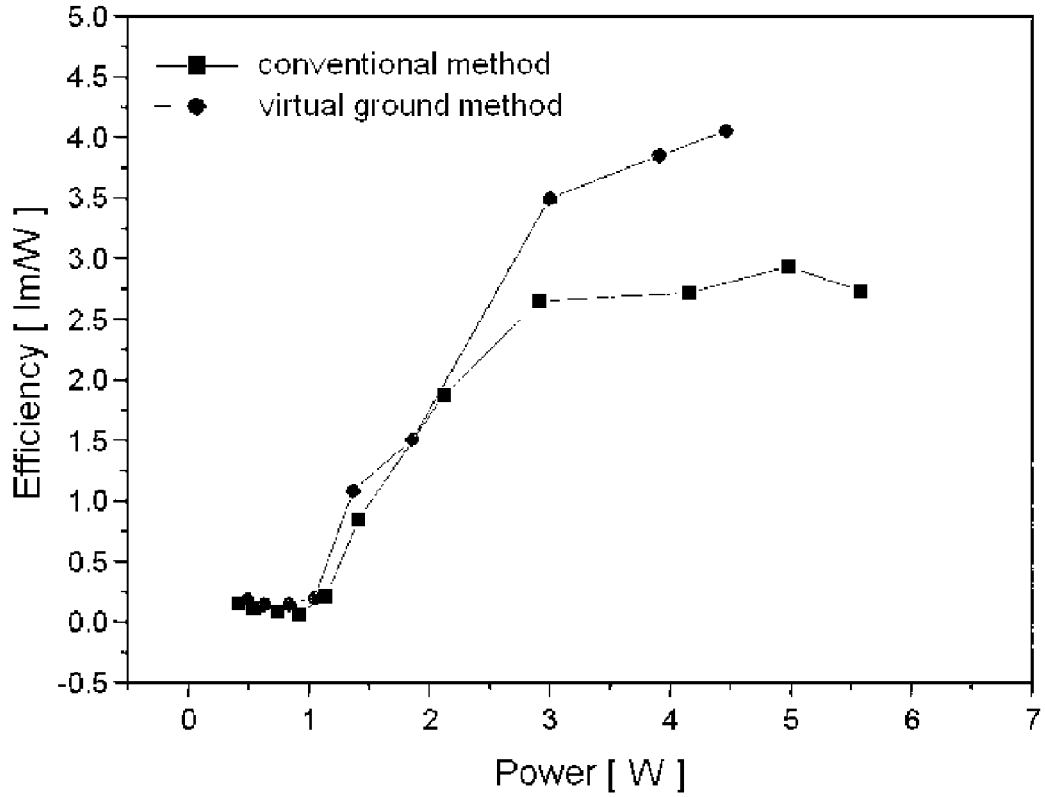

FIELD EMISSION APPARATUS AND DRIVING METHOD THEREOF

TECHNICAL FIELD

The present invention relates to a field emission apparatus and a method of driving the field emission apparatus, which has a three-pole structure of dual emitters formed on both first and second electrodes of a rear substrate in order to obviate a distinction between a gate and a cathode, thus enabling dual field emission. In such a field emission apparatus, a ground is formed between an anode and a point of the first and second electrodes of the rear substrate, and a square wave is applied thereto in order to alternately generate field emission in the first and second electrodes, thus increasing a light-emitting area and emission efficiency, decreasing a driving voltage and consumption power, saving the manufacturing cost and manufacturing time, and accomplishing a longer lifespan.

BACKGROUND ART

Field emission apparatuses that are currently being used, such as a field emission type backlight, a field emission flat lamp (FEFL), a field emission display, and the like, employ a sharp cold cathode as means for emitting accelerated electrons for exciting phosphors, instead of a thermal cathode used in a conventional cathode ray tube. In other words, electrons are emitted through tunneling effect of a quantum mechanics by concentrating a high electric field on the emitter constituting the cold cathode. U.S. Pat. No. 3,970,887 issued to Donald O. Smith, et al. discloses a structure in which a silicon (Si) micro tip is formed in a semiconductor substrate and an electric field is applied to the tip through a gate electrode, thus emitting electrons. This kind of a field emission apparatus is problematic in that it requires a very high gate voltage for electron emission since the work function of a material used in the micro tip is great, and in that the micro tip is easily damaged.

Thus, a diamond film has recently been in the spotlight as the emitter. In recent years, active research has been done on carbon nanotube (CNT) that radiates electrons even in an electric field, which is about 1/10 lower than an electric field for electron emission of the diamond film.

No matter which emitter is used, it can be used practically only when a wide light-emitting area, high brightness, a longer lifespan, and a simplified process are accomplished.

An existing field emission apparatus includes a two-pole or three-pole structure. In the two-pole structure, a method of extracting electrons from a field emission material by applying a high voltage between an anode electrode and a cathode electrode and exciting phosphors with the electrons to emit light is used. The two-pole structure is advantageous in that it demands a low manufacturing cost; it is easy to manufacture them; and a wide light-emitting area can be easily fabricated, but is problematic in that it demands a high driving voltage; and it has low brightness, which can be generated stably, and low emission efficiency.

Korean Patent Laid-Open Publication No. 2000-74609, U.S. Pat. No. 5,773,834, Korean Patent Laid-Open Publication No. 2001-84384, and Korean Patent Laid-Open Publication No. 2004-44101 disclose the field emission apparatuses of the three-pole structure. In the three-pole structure, an auxiliary electrode, called a gate electrode, is spaced apart from a cathode electrode by several tens of nanometers (nm) to several millimeters (mm) in order to easily extract electrons from a field emission material. Phosphors on the anode electrode side are excited with the extracted electrons by applying a high voltage between the anode electrode and the cathode electrode, so that light is emitted. This three-pole structure can lower a driving voltage significantly and generate a high brightness, but has been problematic in that the manufacturing cost is relatively high, manufacturing time is taken long, and a light-emitting area is small.

A lateral gate type field emission apparatus disclosed in Korean Patent Laid-Open Publication No. 2004-44101 is shown in FIG. 1. Referring to FIG. 1, cathode electrodes 10 are formed on a surface of a rear substrate 5. An emitter 20 comprised of carbon nanotube is formed on the cathode electrode 10. A gate electrode 25 is spaced apart from the cathode electrode 10 at a predetermined interval, and is adjacent to the rear substrate 5 by the mediation of an insulating layer 15. A phosphor layer 30, an anode electrode 35 formed of an indium tin oxide (ITO), a front substrate 40 and so on are disposed opposite to the rear substrate 5.

In the conventional field emission apparatus of three-pole structure including the lateral gate type, brightness irregularity occurs since electrons are not radiated from the gate electrode 25 and heavy load is given to the emitter 20 since electrons are radiated only from the emitter 20 formed on the cathode electrode 10. Accordingly, there are problems in that a lifespan is short and brightness is low.

Korean Patent Application No. 2004-70871, which was previously filed by the applicant of the present invention in order to solve the conventional problems, is advantageous in that it can improve brightness and save the manufacturing cost, but does not accomplish the advantages of a ground driving method according to the present invention in a method of driving a field emission apparatus having a dual emitter.

DISCLOSURE OF INVENTION

Technical Problem

Accordingly, the present invention has been made in an effort to solve the above problems occurring in the prior art, and an object of the present invention is to provide a field emission apparatus and a method of driving the same, in which a ground is formed between an anode and a point of first and second electrodes of a rear substrate, and a square wave is applied to generate field emission, thus increasing a light-emitting area and emission efficiency, decreasing a driving voltage and consumption power, saving the manufacturing cost and manufacturing time, and accomplishing a longer lifespan.

Technical Solution

The above object of the present invention is accomplished by a field emission apparatus including a front substrate and a rear substrate spaced apart from each other by a predetermined interval; an anode electrode existing on the front substrate; a phosphor existing on the anode electrode; a first electrode and a second electrode disposed on the rear substrate in such a manner as to be spaced apart from each other by a predetermined interval; and emitters formed on one or more of the first electrode and the second electrode, the field emission apparatus further including a DC inverter for applying power to the anode electrode; and an AC inverter for grounding an intermediate electric potential of an AC wave to the DC inverter and applying power to the first and second electrodes.

The above object of the present invention is accomplished by a method of driving a field emission apparatus, including the steps of applying DC power to an anode electrode formed on a front substrate; grounding an intermediate electric potential of an AC wave to a DC inverter to apply a square wave and an AC pulse to first and second electrodes formed on a rear substrate; allowing emitters, formed on one or more of the first and second electrodes, to alternately emit electric field; and exciting a phosphor formed on the front substrate.

ADVANTAGEOUS EFFECTS

In accordance with a field emission apparatus and a method of driving the same according to the present invention, a virtual ground (in the case of a single transformer, at a secondary coil intermediate tap portion; and in the case of two transformers, at each intermediate tap portion of the two transformers) is formed between a gate electrode and a cathode electrode in which emitters are respectively formed, and is grounded together with a power unit (a DC inverter) of a front substrate.

Therefore, first, a light-emitting area can be increased. Second, a lot of advantages can be accomplished in terms of the manufacturing cost and manufacturing time since there is no distinction between the gate and the cathode. Third, a longer lifespan can be guaranteed. Fourth, consumption power and a driving voltage can be decreased.

Further, if this ground driving method is applied to a conventional lateral gate structure, a driving voltage can be decreased, consumption power can be saved, and brightness and emission efficiency can be increased.

BRIEF DESCRIPTION OF THE DRAWINGS

FIG. 1 shows a conventional field emission apparatus;

FIGS. 2 to 4 show field emission apparatuses according to the present invention;

FIG. 5 is a graph illustrating the comparison of current densities according to the present invention and the prior art;

FIGS. 6 to 21 show driving circuits and waveforms of a grounding method according to the present invention;

FIG. 22 shows an example in which the grounding method of the present invention is applied to a conventional field emission apparatus structure;

FIGS. 23 to 25 are graphs illustrating the comparison of the grounding method according to the present invention and a conventional driving method; and FIGS. 26 to 29 are graphs illustrating the comparison of the grounding method according to the present invention and a conventional driving method in the conventional field emission apparatus structure.

DESCRIPTION ON MAIN REFERENCE NUMERALS

100: rear substrate 105: first electrode
110: second electrode 115: emitter
117: isolation insulating film 119: insulating layer
200: front substrate 205: anode electrode
210: phosphor 300: spacer
305: sealant 400: DC inverter
402: AC inverter 404, 406, 408: transformer

MODE FOR THE INVENTION

The object and technical construction of the present invention and acting effects accordingly will be clearly understood from the following detailed description with reference to the accompanying drawings, illustrating preferred embodiments of the present invention.

FIG. 2 shows a construction of a field emission apparatus according to the present invention.

The field emission apparatus of the present invention includes a first electrode 105 and a second electrode 110 formed on a rear substrate 100, and an emitter 115 formed on the first electrode 105 and the second electrode 110. The above structure has the emitter 115 formed both on the first electrode 105 and the second electrode 110, substantially obviating a distinction between the gate electrode and the cathode electrode in the prior art. The first electrode 105 and the second electrode 110 may serve as the gate or cathode electrode depending on a driving voltage. In this way, an increased light-emitting area, improved emission efficiency, uniform emission, a high brightness, and a longer lifespan can be accomplished.

The rear substrate 100 may include a glass, alumina ($Al_2O_3$), quartz, plastic, silicon (Si) substrate or the like, more preferably the glass substrate.

The first electrode 105 and the second electrode 110 may be formed of metal, such as silver (Ag), chrome (Cr), copper (Cu), aluminum (Al), nickel (Ni), zinc (Zn), titanium (Ti), platinum (Pt), tungsten (W), ITO, or an alloy thereof. The first and second electrodes 105, 110 may be formed suitably by means of a screen-printing method, or alternatively, a method of sintering metal powder or a thin film deposition method such as a sputtering method, a vacuum deposition method and a chemical vapor deposition (CVD).

The emitter 115 may be formed of carbon nanotube, diamond, diamond like carbon (DLC), fulleren or palladium oxide (PdO), more preferably carbon nanotube that can emit electrons at a relatively low voltage.

A transparent electrode 205 and a phosphor 210 are formed over a front substrate 200. There is a spacer 300 for maintaining a distance between the front substrate 200 and the rear substrate 100. A space between the rear substrate 100 and the front substrate 200 is sealed with a sealant 305, such as frit glass, and the inside thereof is kept to a high vacuum of about $10^{-7}$ torr.

The front substrate 200 may be formed of glass, quartz, plastic, etc., more preferably a glass substrate. Further, when both the rear substrate 100 and the front substrate 200 are formed of a plastic substrate, they can be used as a backlight of a scroll liquid crystal display.

The transparent electrode 205 can be formed by depositing, coating or printing a transparent conductive material, such as ITO, on the front substrate 200. The phosphor 210 preferably includes a white phosphor, such as oxide or sulfide in which red, green and blue phosphors are mixed at a ratio, and may be formed by means of a screen-printing method.

FIG. 3 is a cross-sectional view illustrating the arrangement of the first electrode 105 and the second electrode 110. The first electrode 105 and the second electrode 110 may be disposed at equal intervals, as shown in FIG. 3*a*. The first electrode 105 and the second electrode 110 may be brought to each other as a pair in order to lower a driving voltage, as shown in FIG. 3*b*. An isolation insulating film 117 may be disposed between the first electrode 105 and the second electrode 110 in order to prevent a short of the two electrodes, as shown in FIG. 3*c*. The first electrode 105 and the second electrode 110 may be formed with a height step, as shown in FIG. 3*d*. An insulating layer 119 may be formed below the second electrode 110 of FIG. 3*d*.

FIG. 4 is a plan view of the rear substrate of the field emission apparatus according to the present invention. Referring to FIG. 4, the first electrode 105 and the second electrode 110 are juxtaposed in a rake shape. The first electrode 105 and the second electrode 110 are alternately applied with voltages of a different polarity depending on a phase difference, so that electrons are emitted from the emitters 115 disposed on the electrodes. Since electrons are emitted from both the electrodes as described above, a higher current density can be obtained under the same electric field, as shown in FIG. 5, compared with the conventional lateral gate type field emission apparatus of a three-pole structure. Of course, either the first electrode 105 or the second electrode 110 may also be used as the gate electrode.

The field emission apparatus of the present invention includes a direct current (DC) inverter 400 for generating power to be applied to the anode electrode 205 on the front substrate in order to drive the anode electrode 205, and an alternating current (AC) inverter 402 for generating power to be applied to the first electrode and the second electrode.

An internal construction of the AC inverter 402 may be changed in various ways depending on the size of the front substrate 200 and/or the construction of the first and second electrodes.

FIGS. 6 to 21 show driving circuits and driving waveforms illustrating a method of driving the field emission apparatus according to the present invention. According to the present invention, the front substrate 200 having the transparent electrode 205 and the phosphor 210 formed thereon is spaced apart from the rear substrate 100 with the spacer 300 intervened therebetween. The space between the front substrate 200 and the rear substrate 100 is maintained to a high vacuum of about $10^{-7}$ torr and is sealed with the sealant 305, such as frit glass. In this state, the front substrate 200 is connected to the DC inverter 400, and the rear substrate 100 is connected to the AC inverter 402 and is applied with an AC pulse.

FIG. 6 shows the driving circuits of FIGS. 7, 13 and 14. Power from an input power source 401 is first applied to the AC inverter 402. Irregular waveforms are filtered through a power filter unit 402*a*. The power, which has been modified in various ways in a desired shape by means of a power device of a power drive stage 402*c* through a power supply unit 402*b*, is applied to a high voltage generator 402*d*, which then generates a driving pulse. The power applied to the high voltage generator 402*d* is applied to an electrode1 105, an electrode2 110 and a transparent substrate (an anode substrate) 205 through transformers, thus driving the field emission apparatus.

FIG. 7 shows an embodiment of the high voltage generator 402*d* of the AC inverter 402. In the high voltage generator 402*d* of FIG. 7, each driving distribution duty of the first and second electrodes is 50%. This is accomplished by grounding an intermediate electric potential of an AC wave to the DC inverter. In the case of FIG. 7, an intermediate tap region of a secondary coil of the transformer 404 and the DC inverter 400, among the constituent elements of the whole inverter, are commonly grounded and driven. The "ground" preferably takes a virtual ground method in which a stable output can be obtained.

FIGS. 8 to 12 illustrate driving waveforms generated from the high voltage generator 402*d* of FIG. 7. FIG. 8 shows an anode voltage waveform applied to the front substrate 200. It can be seen that a DC waveform is applied through the DC inverter 400.

FIG. 9 shows a cathode voltage waveform applied to the rear substrate 100. As the intermediate tap region of the secondary coil of the transformer 404 and the DC inverter 400 are commonly grounded and driven as described with reference to FIG. 7, the waveforms applied to the first and second electrodes have the same size and amplitude, but different polarities. The first and second electrodes are driven by setting a delay time every cycle or half-cycle of the waveform. The delay time is preferably set to 50□ or less (0 to 50□).

FIG. 10 shows an applied pulse according to the driving distribution duty. This drawing shows a pulse waveform according to the driving distribution duty 50% of each of the first and second electrodes shown in FIG. 7.

FIGS. 11 and 12 show waveforms that have been modified variously by using a power semiconductor device of the power drive stage 402*c* in the AC inverter 402 of FIG. 7. The power semiconductor device may include a diode, a thyristor, a transistor, a metal oxide semiconductor field effect transistor (MOSFET), an insulated gate bipolar transistor (IGBT) or a gate turn-off thyristor (GTO) depending on the type and capacity of an inverter.

FIG. 13 is a circuit diagram for driving two transformers 404, which are connected to each other, when the capacity increases due to increase of the size of the front substrate 200. In this case, an intermediate part of the two transformers and the DC inverter 400 are commonly grounded and driven in the same manner as FIG. 7. The driving waveforms in this case are the same as shown in FIGS. 8 to 12.

FIG. 14 is a circuit diagram of the high voltage generator 402*d* when the heights of the first and second electrodes are set differently. When the position of an electrode serving as the gate is set higher than the position of an electrode serving as the emitter, it can increase efficiency. Thus, a height between the first and second electrodes is set differently.

In this case, emission from an electrode with a higher height to an electrode with a lower height is easy, but emission from an electrode with a lower height to an electrode with a higher height becomes difficult. In other words, field emission from the first electrode 105 to the second electrode 110 is easy, but field emission from the second electrode 110 to the first electrode 105 becomes difficult. Accordingly, the transformers do not have the same turn ratio as shown in FIG. 13, but the transformers 406, 408 have different turn ratios, so that short field emission can be compensated for. Further, efficiency can be further increased by reducing the light-emitting area of the first electrode 105 as shown in FIG. 15.

In the construction of FIG. 15, emission efficiency can be improved by increasing the area of the second electrode 110 and decreasing the area of the first electrode 105 having a high electric field emission voltage. Since the first electrode 105 is positioned higher than the second electrode 110, there is an advantage in that a driving voltage can be lowered compared with the conventional lateral gate structure in which the first electrode 105 and the second electrode 110 are positioned at the same height. Further, there is an advantage in that the light-emitting area can be widened since field emission is also generated in the first electrode 105.

FIG. 16 shows another embodiment of the high voltage generator 402*d* of FIG. 14. That is, in FIG. 16, the increased area of the second electrode 110, which can be seen in FIG. 15, is not applied, but the insulating layer 119 is formed below the first electrode 105, so that electrons can also be emitted from the first electrode and the light-emitting area can be widened accordingly. The insulating layer 119 may also be formed in the structure of FIG. 15.

FIGS. 17 to 21 show driving waveforms appearing in the driving circuits of FIGS. 15 and 16. FIG. 17 shows an anode voltage waveform applied to the front substrate 200. From FIG. 17, it can be seen that a DC waveform is applied through the DC inverter 400.

FIG. 18 shows a cathode voltage waveform applied to the rear substrate 100. An intermediate region between the transformers 406, 408 and the DC inverter 400 are commonly grounded and driven as described with reference to FIGS. 15 and 16. Thus, the waveforms applied to the first and second electrodes have the same size and amplitude, but different polarities. The first and second electrodes are driven with a delay time being set every cycle or half-cycle of the waveform. The delay time is preferably set to 0 to 50□.

In FIGS. 15 and 16, field emission from the first electrode 105 to the second electrode 110 is relatively great compared with field emission from the second electrode 110 to the first electrode 105. This is because it is necessary to emit electrons by applying a higher (+) voltage to the second electrode 110 due to the direction of the voltage applied to the anode. Accordingly, the circuit is configured in order that a higher (+) voltage than that applied to the first electrode 105 is applied to the second electrode 110. A 0V point that has been decided as described above and the minus terminal of the anode voltage can be connected to accomplish bi-directional field emission.

FIG. 19 shows an applied pulse according to the driving distribution duty 50%. The drawing shows a pulse waveform according to the driving distribution duty 50% of each of the first and second electrodes shown in FIGS. 15 and 16.

FIGS. 20 and 21 show waveforms that have been modified in various ways in a desired shape by using the power semiconductor device of the power drive stage 402*c* in the driving circuit of FIGS. 15 and 16. The power semiconductor device may include a diode, a thyristor, a transistor, a MOSFET, an IGBT or a GTO depending on the type and capacity of an inverter.

FIG. 22 shows a structure in which the virtual ground method of the present invention is applied to the conventional lateral gate type three-pole structure. This structure looks similar to the structure shown in FIG. 1, but is driven by applying the transformer turn ratio of the inverter shown in FIG. 14 and the virtual ground method when it is sought to generate more field emission by widening the area of the first electrode 105 or raising the voltage of the first electrode 105, and is quite different from the driving method of FIG. 1.

FIGS. 23 to 25 illustrate the comparison of driving results in the virtual ground method and driving results in the conventional lateral gate type in the dual emitter structure. The drawings illustrate the comparison of the driving methods in the dual emitter structure with the anode voltage being fixed to 3 kV.

FIG. 23 is a graph illustrating current characteristics according to gate voltages (the first electrode or the second electrode). From the graph, it can be seen that anode current values in the virtual ground driving method are higher at the same gate voltage.

FIG. 24 is a graph illustrating brightness according to gate voltages. From the graph, it can be seen that brightness in the virtual ground driving method is almost three times greater at the same gate voltage.

FIG. 25 illustrates efficiency according to gate voltages. From the graph, it can be seen that efficiency in the virtual ground driving method is approximately twice higher at the same gate voltage.

FIGS. 26 to 27 illustrate the comparison of driving results in the virtual ground method and driving results in the conventional lateral gate type in the lateral gate structure. The drawings illustrate the comparison of the driving methods in the lateral gate structure with the anode voltage being fixed to 2 kV. FIG. 26 illustrates anode current values at the same gate voltage. It can be seen that more current flows in the virtual ground driving method.

FIG. 27 illustrates brightness at the same gate voltage. It can be seen that brightness in the virtual ground driving method is almost twice higher at the same gate voltage.

From FIG. 28, it can be seen that brightness in the virtual ground method is almost twice higher at most at the same power. From FIG. 29, it can be seen that efficiency in the virtual ground method is almost twice higher at most at the same power.

In other words, FIGS. 26 to 29 illustrate that greater anode current, brightness, and efficiency can be obtained if the virtual ground driving method is employed even in the lateral gate structure.

It is to be understood that since practical exemplary embodiment described herein and the construction illustrated in the accompanying drawings are merely a most preferred embodiment, but does not all cover the technical spirit of the present invention, various equivalents an modifications capable of replacing them can exist at the point of time of application of the present invention.

The invention claimed is:

1. A field emission apparatus, including a front substrate and a rear substrate spaced apart from each other a predetermined distance, an anode electrode existing on the front substrate, a phosphor existing on the anode electrode;

a first electrode and a second electrode disposed on the rear substrate and spaced apart from each other a predetermined distance and emitters formed on both the first electrode and the second electrode, the field emission apparatus comprising a DC inverter for applying power to the anode electrode; and an AC inverter for grounding an intermediate electric potential of an AC wave to the DC inverter and applying power to the first and second electrodes.

2. The field emission apparatus of claim 1, wherein the AC inverter comprises:

a power filter unit for receiving power from an input power source and filtering irregular waveforms;

a power supply unit for supplying the power applied thereto from the power filter unit to a power drive stage;

a power drive stage for generating power of a desired shape from the power applied thereto from the power supply unit by using a power device, and generating a driving pulse; and a high voltage generator for supplying the power applied thereto from the power drive stage to the first electrode, the second electrode, and the front substrate, the high voltage generator being grounded to the DC inverter.

3. The field emission apparatus of claim 2, wherein the intermediate electrical potential of the AC wave is grounded to the DC inverter by forming a tap at an intermediate electrical potential of one or more transformers of the high voltage generator.

4. The field emission apparatus of claim 3, wherein when the first electrode and the second electrode have the same structure, the tap is formed at a center of the one or more transformers and is grounded to the DC inverter.

5. The field emission apparatus of claim 3, wherein when structures of the first electrode and the second electrode differ in height or area, the tap is formed in the one or more transformers and is grounded to the DC inverter so that a higher voltage can be applied to a higher or wider electrode.

6. The field emission apparatus of claim 2, wherein the first and second electrodes are applied with a square wave and an AC pulse with a delay time from the AC inverter.

7. The field emission apparatus of claim 6, wherein the delay time is set to 50 ms or less.

8. The field emission apparatus of claim 1, wherein the intermediate electric potential of the AC wave is grounded to the DC inverter by forming a tap at an intermediate electric potential of one or more transformers of the high voltage generator.

9. The field emission apparatus of claim 8, wherein the first electrode and the second electrode have the same structure, the tap is formed at a center of the one or more transformers and is grounded to the DC inverter.

10. The field emission apparatus of claim 8, wherein when structures of the first electrode and the second electrode differ in height or area the tap is formed in the one or more transformers and is grounded to the DC inverter so that a higher voltage is being applied to a higher or wider electrode.

11. The field emission apparatus of claim 1, wherein the first and second electrodes are applied with a square wave and an AC pulse with a delay time from the AC inverter.

12. The field emission apparatus of claim 11, wherein the delay time is set to 50 ms or less.

13. A method of driving a field emission apparatus comprising the steps of:

applying DC power to an anode electrode formed on a front substrate;

grounding an intermediate electric potential of an AC wave to a DC inverter to apply a square wave and an AC pulse to first and second electrodes formed on a rear substrate;

allowing emitters formed on both the first and second electrodes to alternatively emit an electric field; and exciting a phosphor formed on the front substrate.

14. The method of claim 13, wherein the square wave and the AC pulse are applied to the first and second electrodes in such a manner that a tap is formed at an intermediate electric potential of one or more transformers and is grounded to the DC inverter for applying power to the anode electrode.

15. The method of claim 14, wherein the first electrode and the second electrode have the same structure, the tap is formed at a center of the one or more transformers and is grounded to the DC inverter.

16. The method of claim 14, wherein when structures of the first electrode and the second electrode differ in height or area, the tap is formed in the one or more transformers and is grounded to the DC inverter so that a higher voltage is being applied to a higher or wider electrode.

17. The method of claim 13, wherein the first electrode and the second, electrode have the same structure, the tap is formed at a center of the one or more transformers and is grounded to the DC inverter.

18. The method of claim 13, wherein when structures of the first electrode and the second electrode differ in height or area, the tap is formed in the one or more transformers and is grounded to the DC inverter so that a higher voltage can be applied to a higher or wider, electrode.

* * * * *